US005397107A

United States Patent [19]

Wolog et al.

[11] Patent Number: 5,397,107

[45] Date of Patent: Mar. 14, 1995

[54] APPARATUS FOR SEPARATING AND FEEDING SHEETS FROM A STACK THEREOF

[75] Inventors: Walter Wolog, Orange; Thomas M. Helit, Bethel; William H. Brewster, Jr., Fairfield, all of Conn.

[73] Assignee: Pitney Bowes Inc., Stamford, Conn.

[21] Appl. No.: 159,064

[22] Filed: Nov. 29, 1993

[51] Int. Cl.[6] ..... B65H 5/00

[52] U.S. Cl. ..... 271/10; 271/110; 271/116; 271/265

[58] Field of Search ..... 271/10, 110, 111, 114, 271/116, 26 S

[56] References Cited

U.S. PATENT DOCUMENTS

| | | | |
|---|---|---|---|
| 3,771,783 | 11/1973 | McInerny | 271/125 |
| 3,977,688 | 8/1976 | Bologna et al. | 281/165 |
| 4,548,400 | 10/1985 | Foster et al. | 271/226 |
| 4,688,708 | 8/1987 | Irvine et al. | 225/100 |
| 4,858,907 | 8/1989 | Eisner et al. | 271/124 |
| 4,973,037 | 11/1990 | Holbrook | 271/146 X |
| 5,006,042 | 4/1991 | Park | 271/111 X |
| 5,085,420 | 2/1992 | Sata | 271/114 |
| 5,163,669 | 11/1992 | Hurd et al. | 271/125 |

*Primary Examiner*—H. Grant Skaggs

*Assistant Examiner*—Carol L. Druzbick

*Attorney, Agent, or Firm*—Robert H. Whisker; Melvin J. Scolnick

[57] ABSTRACT

Apparatus for feeding respective sheets from a stack thereof comprising structure for supporting a plurality of sheets in an upright stack thereof, the supporting structure including an upright wall, the supporting structure including a deck extending beneath the wall and defining a path of travel for respective sheets fed from the stack, the deck extending transverse to the path of travel; structure for successively feeding respective sheets downstream in the path of travel, the feeding structure including opposed outfeed rollers downstream of the upright wall, the feeding structure including an elongate first roller longitudinally extending transverse to the path of travel upstream of the upright wall, the feeding structure including an elongate second roller longitudinally extending transverse to the path of travel upstream of the fist roller, the feeding structure including structure for driving the outfeed and first and second rollers; structure for controlling the driving structure, and the controlling structure including structure for causing the driving structure to continuously drive at least one of the outfeed rollers and to selectively drive the first and second rollers.

8 Claims, 4 Drawing Sheets

FIG. 3

102

| CONTROL CIRCUITS A | PROGRAM COUNTER B | WORKING REGISTERS C | ARITHMETIC LOGIC UNIT D | OSCILLATOR AND CLOCK E | DATA MEMORY F | K SERIAL AND OTHER PROGRAMMABLE PORTS |
|---|---|---|---|---|---|---|
| TIMER AND EVENT COUNTER G | PROGRAM EXPANSION CONTROL H | MAIL LINE PROGRAM MEMORY I | | | SPARE REGISTERS J | |

INCLUDING PROGRAMMING FOR: INITIALIZATION; STORING FIRST AND SECOND COUNTS CORRESPONDING TO $D_1$ AND $D_2$ ; ENERGIZING CLUTCHES 68, 70 FOR CONNECTING GEARS, 70, 80 TO ROLLERS 48, 50 AND ENERGIZING D.C. MOTOR 84 IN RESPONSE TO TEST SIGNAL 130; COMMENCING THIRD COUNT OF ENCODER SIGNALS 122 IN RESPONSE TO SENSOR 110 PROVIDING A SIGNAL 130 INDICATING THAT A SHEET LEADING EDGE 12a HAS BEEN SENSED, AND ENDING THE THIRD COUNT OF SIGNALS 122 IN RESPONSE TO THE SENSING SIGNAL 130 INDICATING THAT THE TRAILING EDGE 12b HAS BEEN SENSED; STORING THE THIRD COUNT, WHICH CORRESPONDS TO THE SHEET-LENGTH "L"; COMPARING THE THIRD COUNT AND SECOND COUNT AND, IF THE THIRD COUNT IS GREATER, STORING A FOURTH, DIFFERENCE COUNT, WHEREAS IF THE THIRD COUNT IS LESS, STORING A FIFTH DIFFERENCE COUNT; IF SHEET-LENGTH KEYS 129 ARE PROVIDED, STORING A SIXTH COUNT IN RESPONSE TO EACH SIGNAL 130 FROM A SELECTED SHEET-LENGTH KEY 129, CORRESPONDING TO THE LENGTH "L" SELECTED; ENERGIZING CLUTHES 68, 70 AND D.C. MOTOR 84, IF SHEET-LENGTH "L" IS GREATER THAN DISTANCE $D_2$ FROM ROLLER 50 TO SENSING STRUCTURE 110, IN RESPONSE TO SIGNAL FROM ON-LINE KEY 128; OPERATING CLUTCH 68, BUT NOT 70, IF SHEET-LENGTH "L" IS LESS THAN THE DISTANCE $D_2$ BETWEEN SECOND ROLLER AND SENSING STRUCTURE 110, IN RESPONSE TO SIGNAL FROM ON-LINE KEY 128; IF SHEET-LENGTH "L" IS GREATER THAN THE DISTANCE $D_2$ START SEVENTH COUNT OF ENCODER SIGNALS 122 WHEN THE SHEET LEADING EDGE 12a IS SENSED BY THE SENSING STRUCTURE 112 AND DEENERGIZE THE SECOND CLUTCH 78 WNEH THE SEVENTH COUNT CORRESPONDS TO THE DIFFERENCE BETWEEN THE SHEET-LENGTH "L" AND DISTANCE $D_2$; ENERGIZING FIRST CLUTCH 68 BUT NOT SECOND CLUTCH 78 AND STARTING SEVENTH COUNT OF ENCODER SIGNALS 122 IN RESPONSE TO SENSING THE LEADING EDGE 12a OF A SHEET; DEENERGIZING THE FIRST CLUTCH 68 WHEN THE SEVENTH COUNT IS EQUAL TO THE DIFFERENCE BETWEEN THE SHEET-LENGTH "L" AND THE DISTANCE "$D_1$"; COMMENCING A COUNT CORRESPONDING TO A PREDETERMINED TIME DELAY "TD" CORRESPONDING TO THE DISTANCE FROM THE TRAILING EGDE 12b OF A LOWERMOST SHEET 12 FED FROM THE STACK 14 AND THE LEADING EDGE 12a OF THE NEXT LOWERMOST SHEET 12 TO BE FED FROM THE STACK 14; AND DEENERGIZING CLUTCHES 68, 78 AND D.C. MOTOR 84 IN RESPONSE TO SECOND DEPRESSION OF ON-LINE KEY. IN ADDITION, PROGRAMMING IS PROVIDED FOR: STEPS SET FORTH IN FIG. 4, TO THE EXTENT THAT THEY ARE NOT PROVIDED FOR ABOVE, ANY OTHER PROCESSING STEPS DISCUSSED IN THE SPECIFICATION, OR WHICH MAY BE CONTINUOUSLY REQUIRED TO BE IMPLEMENTED IN THE COURSE AND ANY PROGRAMMING OF IMPLEMENTATION OF ANY OF THE AFORESAID PROGRAMMING.

APPARATUS FOR SEPARATING AND FEEDING SHEETS FROM A STACK THEREOF

BACKGROUND OF THE INVENTION

This invention is generally concerned with apparatus for feeding sheets from a stack of sheets and, more particularly, for feeding respective sheets one at a time from the bottom of an upright stack of sheets on a deck, including means for compensating for variations in forces exerted on the respective sheets by the stack and deck as the respective sheets are fed from the stack.

U.S. Pat. No. 3,977,668 for DUAL PURPOSE SHEET MATERIAL FEEDING AND SAFETY APPARATUS, issued Aug. 31, 1976 to Bologna, et al. and assigned to the assignee of the present invention, discloses an upright stack of sheets which is supported on a feed deck inclined at an angle relative to an upright wall for urging an edge of each of the sheets into registration with the wall. In addition, there is disclosed opposed output feed rollers situated at the junction between the deck and wall for feeding respective sheets one at a time from the bottom of the stack.

U.S. Pat. No. 4,973,037 for a FRONT END FEEDER FOR MAIL HANDLING MACHINE, issued Nov. 27, 1990 to Holbrook and assigned to the assignee of the present invention, discloses sheet feeding apparatus comparable to the apparatus shown in the aforesaid '668 patent, for use in a high speed machine for handling mixed mail pieces, wherein a drive assembly is provided for feeding successive mailpieces from the bottom of the stack of sheets while maintaining the mailpieces in registration with a fence and fluffing the stack to promote separation of the respective mailpieces from one and other.

When the aforesaid sheet feeding apparatus and like structures are utilized for separating large envelopes or other sheets, the individual sheets may weigh so much that the frictional forces exerted by the stack and deck against the drive forces exerted by the feed rollers are such that the respective sheets either cannot be fed from the stack or are misfed therefrom. This ordinarily occurs in due to the forces exerted by the feed rollers being insufficient to overcome the static frictional forces exerted by the deck and stack on the lowermost sheet of the stack, or, as a given sheet is exiting the stack, due to the normal force exerted by the stack on the given sheet being insufficient to permit the opposed outfeed roller to frictionally engage and feed the sheet from beneath the stack. In any event, any given sheet being fed from the bottom of a stack is subjected to a wide range of normal forces in the course of being fed therefrom. Accordingly,

- an object of the invention is to provide an apparatus for feeding respective sheets from a stack thereof including means for compensating for variations in forces exerted on the respective sheets in the course of feeding the same;
- another object is to provide such compensating means including a microcomputer programmed for intermittently driving respective rollers engaging the lowermost sheet of the stack to ensure separation of the sheets and feeding the sheets from the stack; and
- another object is to provide structure for controlling a plurality of sheet feeding rollers, engaging successive lowermost sheets of the stack, in consideration of the length of such sheets in the direction of feeding.

SUMMARY OF THE INVENTION

Apparatus for feeding respective sheets from a stack thereof comprising means for supporting a plurality of sheets in an upright stack thereof, the supporting means including an upright wall, the supporting means including a deck extending beneath the wall and defining a path of travel for respective sheets fed from the stack, the deck extending transverse to the path of travel; means for successively feeding respective sheets downstream in the path of travel, the feeding means including opposed outfeed rollers downstream of the upright wall, the feeding means including an elongate first roller longitudinally extending transverse to the path of travel upstream of the upright wall, the feeding means including an elongate second roller longitudinally extending transverse to the path of travel upstream of the first roller, the feeding means including means for driving the outfeed and first and second rollers; means for controlling the driving means, and the controlling means including means for causing the driving means to continuously drive at least one of the outfeed rollers and to selectively drive the first and second rollers.

BRIEF DESCRIPTION OF THE DRAWINGS

As shown in the drawings, wherein like reference numerals designate like or corresponding parts throughout the several views:

FIG. 3 is a schematic view of the microcomputer of the invention and;

DESCRIPTION OF THE PREFERRED EMBODIMENTS

Figure 1:
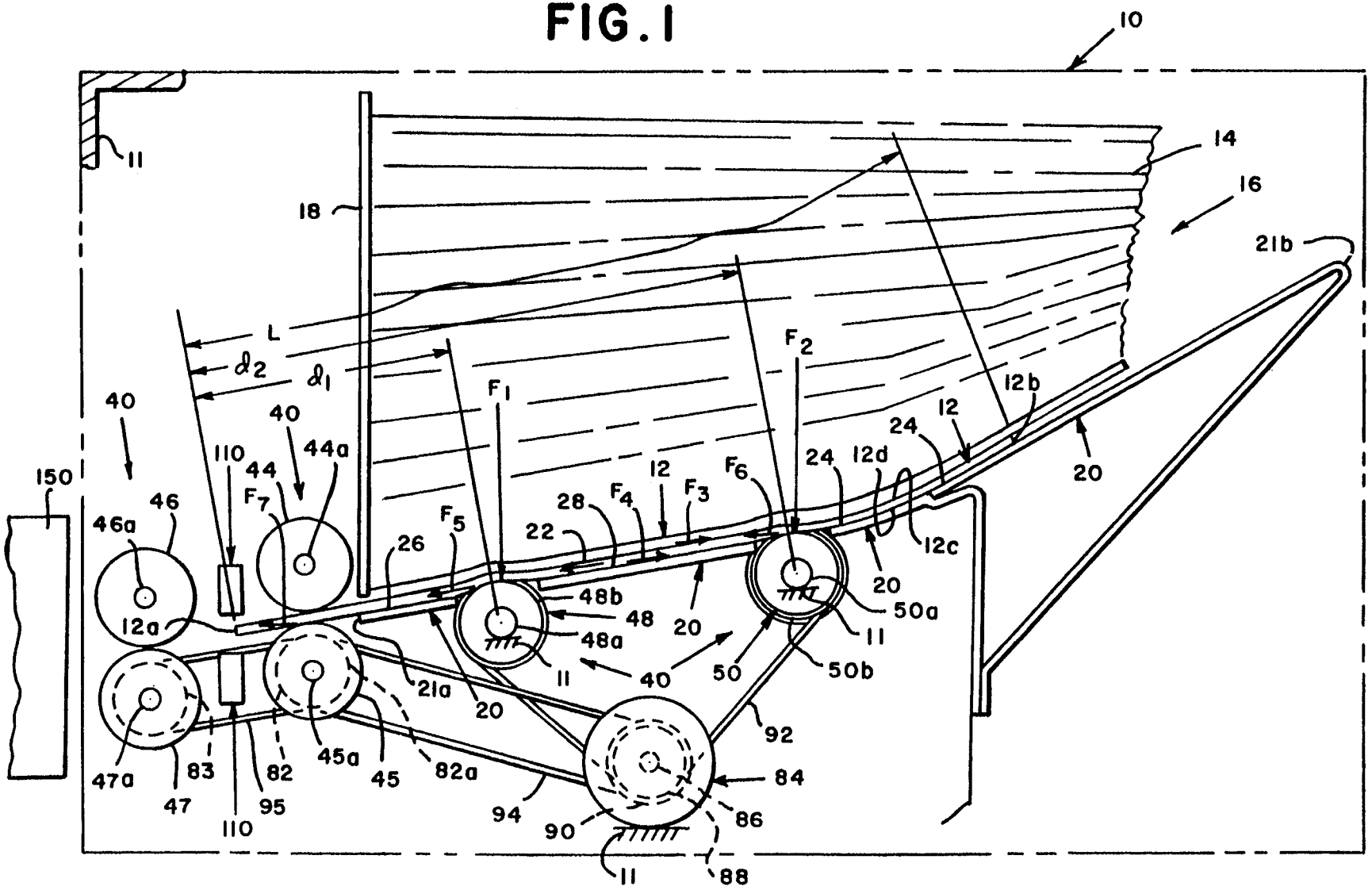
FIG. 1 is a schematic elevation of the sheet supporting and feeding structures according to the invention for feeding lowermost sheets from a stack thereof.
Figure 2:
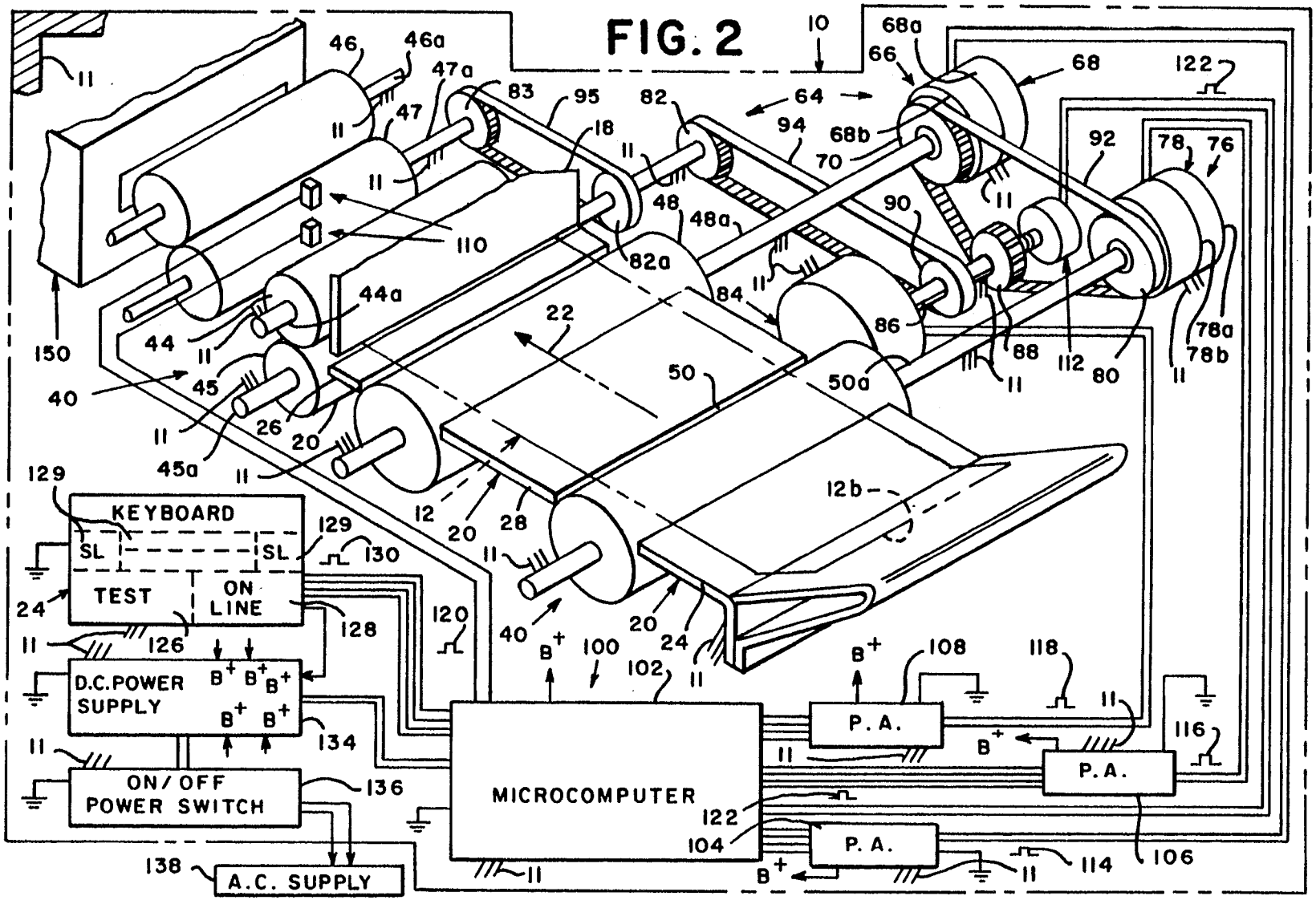
FIG. 2 is a schematic view, partially in perspective, of sheet feeding apparatus according to the invention, including structure for controlling the apparatus.

As shown in FIG. 1, according to the invention there is provided apparatus 10 for feeding respective sheets 12 from a stack 14 of sheets 12, including conventional framework 11 for supporting the various components of the apparatus 10. The sheet feeding apparatus 10 includes structure 16 for supporting a plurality of the sheets 12 in an upright stack 14, including a substantially vertically extending upright wall 18. In addition, the supporting structure 16 includes a deck 20 which extends beneath the wall 18 and thus defines a path of travel 22 extending therebeneath in which respective sheets 12 are fed from the stack 14. The deck 20 is preferably inclined upwardly from the downstream end 21*a* thereof to the upstream end 21*b* thereof, for urging the respective sheets 12 of the stack 14 into edge registration with the upright wall 18. And, as shown in FIG. 2, the deck 20 extends transverse to the path of travel 22 of respective sheets 12 fed from the stack 14. Moreover, the deck 20 preferably includes three portions thereof defining the path of travel 22, that is, an upstream portion 24 and a downstream portion 26, and a middle portion 28 between the upstream portion 24 and the downstream portion 26 which is spaced apart therefrom.

In addition, the sheet feeding apparatus 10 (FIG. 1) includes structure 40 for successively feeding respective sheets 12 downstream in the path of travel 22. Thus, each of the sheets 12 in the path of travel 22 has a leading edge 12*a* and a trailing edge 12*b*, and has a predetermined overall length "L" as measured in the path of travel 22 from the leading edge 12*a* to trailing edge 12*b* thereof. The feeding structure 40 also preferably includes a pair of opposed upper and lower outfeed rollers, respectively designated 44 and 45. The outfeed rollers 44, 45, are each elongate rollers which are conventionally coaxially mounted on drive shafts 44*a* (FIG. 2) and 45*a*. The drive shafts, 44*a* (FIG. 2) and 45*a*, are respectively suitably journaled to the framework 11 for rotation, so that the respective rollers, 44 and 45, longitudinally extend transverse to the path of travel 22, downstream from the upright wall 18, for engaging and feeding sheets 12 fed therebetween from the stack 14. Further, the feeding structure 40 additionally preferably includes a pair of opposed upper and lower take-away rollers, respectively designated 46 and 47. The take-away rollers, 46, 47, are each elongate rollers which are conventionally coaxially mounted on drive shafts 46*a* and 47*a*. The drive shafts, 46*a* and 47*a*, are respectively suitably journaled to the framework 11 for rotation, so that the respective rollers, 46 and 47, longitudinally extend transverse to the path of travel 22, downstream from the outfeed rollers, 44 and 45, for engaging and feeding sheets 12 fed thereby between the take-away rollers, 46 and 47. Moreover, the feeding structure 40 includes an elongate, first, pre-feed, roller 48, which is conventionally coaxially mounted on a drive shaft 48*a*. The drive shaft 48*a* is suitably journaled to the framework 11 for rotation, so that the roller 48 longitudinally extends transverse to the path of travel 22, upstream of the upright wall 18 and between the downstream deck portion 26 and middle deck portion 28. Further, the feeding structure 40 includes an elongate, second, pre-feed roller 50, which is conventionally coaxially mounted on a drive shaft 50*a*. And the drive shaft 50*a* is suitably journaled to the framework 11 for rotation so that the roller 50 longitudinally extends transverse to the path of travel 22, upstream from the upright wall 18 and between the middle deck portion 28 and upstream deck portion 24.

For driving the outfeed rollers, 44, 45 (FIG. 1), take-away rollers, 46, 47, and pre-feed rollers 48, 50, the sheet feeding structure 40 preferably includes structure 64 (FIG. 2) for driving at least one of each of the pairs of rollers, 44, 45, and 46, 47, and for driving each of the rollers, 48 and 50. The driving structure 64 preferably includes a first electro-magnetic clutch system 66, including a first clutch 68, having a first portion 68*a* and a second portion 68*b*, and including a first drive gear 70. The clutch portion 68*a* is conventionally mechanically connected to the first roller drive shaft 48*a*, and the second clutch portion 68*b* is conventionally mechanically connected to the first drive gear 70. Moreover, the clutch 68 is conventionally constructed and arranged to be electrically operable for magnetically connecting the first and second clutch portions, 68*a* and 68*b*, to one another for connecting the first drive gear 70 to the first roller drive shaft 48*a*, to permit the first roller 48 to be driven by the gear 70, and for disconnecting the first and second clutch portions, 68*a* and 68*b*, from one another for disconnecting the first drive gear 70 from the first roller drive shaft 48*a*, to prevent the first roller 48 from being driven by the gear 70. Preferably, the driving structure 64 additionally includes a second electromagnetic clutch system 76, including a second clutch 78, having a first portion 78*a* and a second portion 78*b*, and including a second drive gear 80. The clutch portion 78*a* is conventionally mechanically connected the second roller drive shaft 50*a*, and the second clutch portion 78*b* is conventionally mechanically connected to the second drive gear 80. Moreover, the clutch 78 is conventionally constructed and arranged to be electrically operable for magnetically connecting the first and second clutch portions, 78*a* and 78*b*, to one another for connecting the second drive gear 80 to the second roller drive shaft 50*a*, to permit the second roller 50 to be driven by the gear 80, and for disconnecting first and second clutch portion, 78*a* and 78*b*, from one another for disconnecting the second drive gear 80 from the second roller drive shaft 50*a*, to prevent the second roller 50 from being driven by the gear 80. Further, the driving structure 64 also preferably includes third, fourth and fifth drive gears 82, 82*a* and 83. Preferably the drive gears 82 and 82*a* are conventionally fixedly connected to the lower outfeed drive shaft 45*a*, and the drive gear 83 is conventionally fixedly connected to the lower take-away roller drive shaft 47*a*, for driving the lower outfeed and take-away rollers 45 and 47. Moreover, the driving structure 64 includes a conventional d.c. motor 84 which includes an output drive shaft 86, and includes first and second pinion gears, respectively designated 88 and 90. The pinion gears, 88, 90, are spaced apart from one another and respectively suitably, fixedly, connected to the d.c. motor output drive shaft 86 for driving thereby. In addition, the driving structure 64 includes a first gear belt 92, which is looped about the first pinion gear 88 and about the respective clutch system drive gears, 70 and 80, and is disposed in meshing engagement therewith for transmitting motive power from the d.c. motor 84 to the pre-feed rollers, 48, 50. The driving structure 64 also includes a second gear belt 94 which is looped about the second pinion gear 90 and about the lower outfeed roller drive gear 82, and is disposed in meshing engagement therewith for transmitting motive power from the d.c. motor 84 to the outfeed roller 45. And, the driving structure includes a third gear belt 95 which is looped about the drive gear 82*a* and about the lower take-away roller drive gear 83, and is disposed in meshing engagement therewith for transmitting motive power from the lower output roller drive shaft 45*a* to the lower take-away roller drive shaft 47*a* and thus to the take-away roller 47.

The apparatus 10 (FIG. 2) additionally includes structure 100 for controlling the driving structure 64. The controlling structure 100 includes a microcomputer 102, which is preferably any commercially available microprocessor having sufficient capacity to store the programs and other data, and to implement the counting, timing, calculating and other functions, hereinafter discussed. In addition, the controlling structure 100 includes a plurality of power amplifiers, including first, second and third power amplifiers respectively designated 104, 106, and 108. Further, the controlling structure 100 includes structure 110 for sensing sheets 12 fed from the stack 14 (FIG. 1). And, the controlling structure 100 (FIG. 2) includes structure 112 for providing counts corresponding to the overall length "L" (FIG. 1) of respective sheets 12, and increments of the respective lengths "L" thereof, in the path of travel 22. The power amplifiers 104 (FIG. 2), 106 and 108, sensing structure 110 and counting structure 112 are preferably any commercially available components of their respective types which are suitable for implementing the respective functions hereinafter ascribed thereto.

The first power amplifier 104 (FIG. 2) is conventionally electrically connected between the microcomputer 102 and first clutch 68 for providing signals thereto, such as the signal 114, for operation of the first clutch 68 under the control of the microcomputer 102. The second power amplifier 106 is conventionally connected between the microcomputer 102 and second clutch 78 for providing signals thereto, such as the signal 116, for operation of the second clutch 78 under the control of the microcomputer 102. The third power amplifier 108 is conventionally electrically connected between the microcomputer 102 and d.c. motor 84 for providing signals thereto, such as the signal 118, for operation of the d.c. motor 84 under the control of the microcomputer 102. The microcomputer 102 is conventionally electrically connected to the sensing structure 110 for receiving successive signals, such as the signal 120, therefrom in response to the sensing structure 110 sequentially sensing the leading and trailing edges, 12*a* (FIG. 1) and 12*b*, of respective sheets 12 fed thereto and therefrom. The counting structure 112 (FIG. 2) is conventionally mechanically connected to the d.c. motor drive shaft 86 for operation thereby. And, the microcomputer 102 is conventionally electrically connected to the counting structure 112 for receiving sequential signals, such as the signal 122, therefrom in response to the counting structure 112 sensing sequential increments of angular displacement of the motor drive shaft 86. The controlling structure 100 also includes a conventional keyboard 124, including a manually operable, first, switching, key 126 which is preferably a depressible test key, and including a manually operable, second, switching, key 128, which is preferably a depressible on-line key. Optionally, the keyboard 124 may also include a plurality of manually operable, third, switching, keys 129, each of which is preferably a sheet-length selection key 129, representative of the overall length "L" of a different commercially available sheet 12. The keyboard 124 is suitably electrically connected to the microcomputer 102 for providing signals thereto, such as the signal 130, in response to manual depression of the test and on-line keys, 126, 128, and, assuming provision of the sheet-length keys 129, in response to manual depression of each of the sheet-length keys 129. Moreover, the apparatus 10 includes a conventional d.c. power supply 134, and includes a conventional power switch 136 which is suitably electrically connected to the d.c. power supply 134 and adapted to be conventionally connected to an external source of supply of a.c. power 138 for a.c. energization and deenergization of the d.c. power supply 134 in response to manual operation of the switch 136. And, the d.c. power supply 134 is suitably electrically connected to the microcomputer 102, power amplifiers 104, 106 and 108, d.c. motor 84 and keyboard 124, for d.c. energization, B+, thereof in response to a.c. energization of the d.c. power supply 134.

As shown in FIG. 3, the microcomputer 102 generally comprises a plurality of discrete circuits, including those for a central processing unit, including a plurality of control circuits "A", a program counter "B", a plurality of working registers "C" and an arithmetic logic unit "D", and those for an oscillator and clock "E", data memory "F", timer and event counters "G" and program expansion control "H". Further, the microcomputer 102 comprises a plurality of additional discrete circuits including those for a plurality of program memories, including a main line program memory "I". Moreover, the microcomputer 102 preferably includes a plurality of spare registers "J" for future use as working registers or for future programming. And, the microcomputer 102 includes a plurality of serial and other programmable ports "K" which are conventionally interconnected as hereinbefore discussed to the d.c. motor 84, power amplifiers 104, 106 and 108, sensing structure 110, and counting structure 112, and to the keyboard 124 for communication therewith.

As shown in FIG. 1, the weight of the stack 14 on the pre-feed rollers, 48 and 50, exerts vertically oriented forces F1 and F2 against the respective pre-feed rollers, 48 and 50, whether or not sheets 12 are being fed from the stack 14. Assuming actuation of the on-line key 130 (FIG. 2), with the result that sheet feeding is commenced, then, as a given lowermost sheet 12 (FIG. 1) is initially being fed from the stack 14 by the pre-feed rollers, 48, 50, the stack 14 exerts an upstream directed frictional force $F_3$ against the upper surface 12*c* of the lowermost sheet 12, and, in addition, the deck 20 exerts an upstream directed frictional force $F_4$ against the lower surface 12*d* of the lowermost sheet 12. Moreover, the upstream directed frictional forces $F_3$ and $F_4$ are exerted against downstream directed forces $F_5$ and $F_6$ exerted by the respective first and second pre-feed rollers, 48, 50, against the lowermost sheet 12. Thereafter, as the lowermost sheet 12 is fed to and between the outfeed rollers, 44, 45, the outfeed rollers, 44, 45, engage and feed the lowermost sheet 12, thereby adding to the pre-feed roller forces, $F_5$ and $F_6$, an additional downstream directed outfeed roller force $F_7$. As sheet feeding continues, the sheet sensing structure 110 senses passage of the leading edge 12*a* of the lowermost sheet 12, and, the upstream directed frictional forces, $F_3$ and $F_4$, are continually reduced as a shorter and shorter portion of the overall length "L" of the lowermost sheet 12 is disposed in engagement with a stack 12 and deck 20. Eventually, the trailing edge 12*b* of the lowermost sheet 12 disengages the second pre-feed roller 50. Whereupon, according to the invention, drive to the second pre-feed roller 50 is stopped to prevent the second pre-feed roller 50 from feeding the sheet 12 next to the lowermost sheet 12 from the stack 14 and into overlapping relationship with the lowermost sheet 12 being fed from the stack 14. As sheet feeding further continues, the outfeed rollers 44, 45, and first pre-feed roller 48, but not the second pre-feed roller 50, feed the lowermost sheet 12 from the stack 14, against the diminished upstream directed frictional forces, $F_3$ and $F_4$, exerted by the stack 14 and deck 20. And, according to the invention, when such sheet feeding results in the trailing edge 12*b* of the lowermost sheet 12 disengaging the first pre-feed roller 48, drive to the first pre-feed roller 48 is also stopped, to prevent the first pre-feed roller 48 from feeding the sheet 12 next to the lowermost sheet 12 from the stack 14 and into overlapping relationship with the lowermost sheet 12. Thereafter, as sheet feeding still further continues, the outfeed rollers, 44, 45, but not the first or second pre-feed rollers, 48 or 50, feed the lowermost sheet 12 from the stack 14 against the greatly reduced upstream directed frictional forces, $F_3$ and $F_4$, exerted by the stack 14 and deck 20 on the lowermost sheet 12. According to the invention, as sheet feeding continues, as above discussed, the lowermost sheet 12 is fed downstream from the stack 12 to the take-away rollers, 46, 47, which, without departing from the spirit and scope of the invention, may be augmented or replaced by any conventional structure 150, externally of the apparatus 10, such as any suitable printing, folding, inserting or other sheet processing structure which is equipped for receiving and feeding the lowermost sheet 12 either away from the apparatus 10, in the case of augmentation of the take-away rollers, 46, 47, or away from the sensing structure 100 and thus away from the apparatus 10, in the case of replacement of the take-away rollers, 46, 47. In any event, as the lowermost sheet 12 is fed away from the outfeed rollers 44, 45, the sensing structure 110 senses passage of the trailing edge 12*b* of the moving sheet 12. According to the invention, after a predetermined time delay "td" from the sensing structure 110 sensing the trailing edge 12*b* of a sheet 12, fed from the stack 14 the feeding structure 64 commences feeding the next lowermost sheet 12 from the stack 14, and so on, until the stack 14 of sheets 12 is depleted.

For implementation of the invention, the microcomputer 102 (FIG. 3), is conventionally programmed for storing in the data memory "F", data in the form of predetermined first and second counts corresponding, respectively, to the distance $d_1$ between the first pre-feed roller's outer periphery 48*b* and the sensing structure 110, and the distance $d_2$ between the second pre-feed roller's outer periphery 50*b* and the sensing structure 110, as measured along the path of travel 22. And, it is noted that each of such counts corresponds to increments of the distances $d_1$ and $d_2$ which are equivalent to the increments of length "L", hereinafter discussed, which are counted by the microcomputer 102 in response to signals 122 received thereby from the counting structure 112.

For determining the overall length "L" of the respective sheets 12 of a stack 14 thereof which is to be fed from the sheet supporting structure 16, a given, representative, sheet 12 having the length "L" of each of the sheets 12 of the stack 14 is placed on the deck 20 with the leading edge 12*a* thereof disposed in the nip between the outfeed rollers, 44, 45, for feeding thereby downstream in the path of travel 22, and, the test key 126 is manually depressed.

The microcomputer 102 (FIG. 3) has stored in the main line program circuitry "I", programming for causing the microcomputer 102 to selectively energize the first and second clutches, 68 and 78, for connecting the drive gears, 70, 80, to the pre-feed roller drive shafts, 48*a*, 50*a*, and to commence energization of the d.c. motor 84 to selectively drive the outfeed, take-away and pre-feed rollers 44, 45, 46, 47, 48 and 50, in response to the microcomputer 102 receiving a signal 130 indicating that the test key 126 has been actuated. Accordingly, when the test key 126 is depressed, the rollers 44, 45, 48 and 50 feed the given sheet 12 downstream in the path of travel 22 to the sensing structure 110, which sequentially senses passage of the leading and trailing edges 12*a* and 12*b* of the given sheet 12 and provides sequential signals 130 indicative thereof to the microcomputer 102. In addition, the counting structure 112, which is preferably a conventional motor drive shaft encoder, sequentially senses angular displacements of the motor drive shaft 86 corresponding to equal increments of the length "L" of respective sheets 12 fed downstream in the path of travel 22. And, the microcomputer's main line program circuitry "I" is programmed to cause the microcomputer 102 to commence a third count of the sequential signals 122 received from the shaft encoder 112 in response to the microcomputer 102 receiving the first signal 130 from the sensing structure 110, indicating that the leading edge 12*a* of the sheet 12 has been sensed, and to end the third count in response to the microcomputer 102 receiving the second signal 130 from the sensing structure 110, indicating that the trailing edge 12*b* of the sheet 12 has been sensed. Moreover, the microcomputer circuitry "I" is programmed to cause the aforesaid third count, which corresponds to the overall length "L" of the given sheet 12, to be stored in the data memory "F". In addition, the main line program circuitry "I" includes programming for causing the microcomputer 102 to conventionally compare the third count to the second count, as by calculating the difference therebetween, to determine if the third count is greater or less than the second count. Further, the aforesaid programming causes the microcomputer 102 to store a fourth count corresponding to the difference therebetween in the data memory "F" if the third count is greater, it being noted that the fourth, difference, count corresponds to the portion of the length "L" of the given sheet 12 which extends upstream of the second pre-feed roller's outer periphery 50*a*. On the other hand, if the aforesaid comparison indicates that the third count is less than the second count, then, the aforesaid programmed circuitry "I" causes the microcomputer 102 to store a fifth count corresponding to the difference between the sheet length "L" and the distance "$d_1$" between the first pre-feed roller's outer periphery 48*b* and the sensing structure 110, in the data memory "F", it being noted that the fifth, difference, count corresponds to the portion of the overall length "L" of the given sheet 12 which extends upstream of the first pre-feed roller's outer periphery 48*a*.

Assuming as hereinbefore discussed that the keyboard 124 includes the optional, sheet-length selection, keys 129, then, the test key 126 does not have to be depressed, nor for that matter be provided, for causing a representative sheet 12 to be fed from the sheet supporting structure 16. Further, the microcomputer 102 need not be programmed as hereinbefore discussed for sensing the sheet's leading and trailing edges, 12*a* and 12*b*, to establish the third count representative of the overall length "L" of a given sheet 12. Rather, the operator may select a key 129 corresponding to the length "L" of a given, representative, sheet 12, as by depressing that key 129, for providing a signal 130 to the microcomputer 102 corresponding to the predetermined sheet length "L". And, the microprocessor 102 may be programmed for providing a sixth count corresponding the selected overall length "L" of the representative sheet 12 in response to the sheet length selection key signal 130. Thereafter, the microcomputer 102 may implement the remainder of the aforesaid programming by comparing the sixth count, rather than the third count, to the second count. However, notwithstanding the foregoing discussion, all of the aforesaid programming is preferably provided to ensure that the overall length "L" of any sheet 12, whether or not a sheet-length selection key 129 is provided therefor, may be established through implementation of such programming.

Assuming implementation of the foregoing programming, and that a stack 14 (FIG. 1) of sheets 12, corresponding to the representative sheet 12 is loaded into the supporting structure 12, then, the on-line key 128 may be manually depressed to cause the apparatus 10 to sequentially feed each successive lowermost sheet 12 from the stack 12, as hereinbefore discussed. To that end, the microcomputer 102 circuitry "I" (FIG. 3) is programmed for causing the microcomputer 102 to energize both of the first and second clutches, 68 and 78, if the given sheet length "L" is greater than the distance $d_2$ between the second pre-feed roller's periphery 50*b*, as measured along the path of travel 22, for connecting the drive gears, 70, 80, to the pre-feed roller drive shafts, 48*a*, 50*a*, and to commence energization of the d.c. motor 84 to drive the outfeed, take-away and both of the pre-feed rollers 44, 45, 46, 47, 48 and 50, in response to the microcomputer 102 receiving a signal 130 indicating that the on-line key 128 has been actuated. On the other hand, if the given sheet length "L" is less than the distance $d_2$ between second pre-feed roller's outer periphery 50*b*, as measured along the path of travel 22, then, the programming causes the microcomputer 102 to energize the first clutch 68, but not the second clutch 78 for connecting the drive gear 70 to the pre-feed rollers drive shaft 48*a* and to commence energization of the d.c. motor 84 to drive the outfeed, take-away and first pre-feed roller 44, 45, 46, 47 and 48, but not the second pre-feed roller 50. Accordingly, when the on-line key 128 is depressed, the rollers 44, 45 and 48 alone or in combination with the roller 50, feed a given, lowermost, sheet 12 downstream in the path of travel 22 to the sensing structure 110, which senses passage of the leading edge 12*a* of the lowermost sheet 12 and provides a signal 130 indicative thereof to the microcomputer 102. In response to the signal 130, the programming of the microcomputer 102 commences a seventh count of sequential encoding signals 114 received by the microcomputer 102. Assuming the sheet length "L" is greater than the distance "$d_2$" then when the seventh count is equal to the fourth count, i.e., corresponding to the difference between the sheet length "L" and the distance "$d_2$", the microcomputer programming causes the second clutch 78 to be deenergized for disconnecting the drive gear 80 from the roller drive shaft 50*a* to cause the second pre-feed roller 50 to stop being driven by the d.c. motor 84. And, thereafter, or if the moving sheet length "L" is less than the distance $d_2$, when the seventh count is equal to the fifth count, i.e., corresponding to the difference between the sheet length "L" and the distance "$d_1$" between the first pre-feed roller's outer periphery 48*b* and the sensing structure 110, as measured along the path of travel 22, the microcomputer programming causes the first clutch 68 to be operated for disconnecting the drive gear 70 from the first roller's drive shaft 48*a* to cause the first pre-feed roller 48 to stop being driven by the d.c. motor 84. Thereafter, independently of the length "L" of the sheet 12 being fed, when the sheet's trailing edge 12*b* is sensed by the sensing structure 110 the programming causes the microcomputer 102 to commence an eighth count of a predetermined time delay "td" before the next lowermost sheet 12 is fed from the stack 14, as a result of which the trailing and leading edges, 21*b* and 21*a*, of successive sheets 12 fed from the stack 14 are separated from one another by a predetermined distance corresponding to the count of the predetermined time delay "td".

Figure 4:
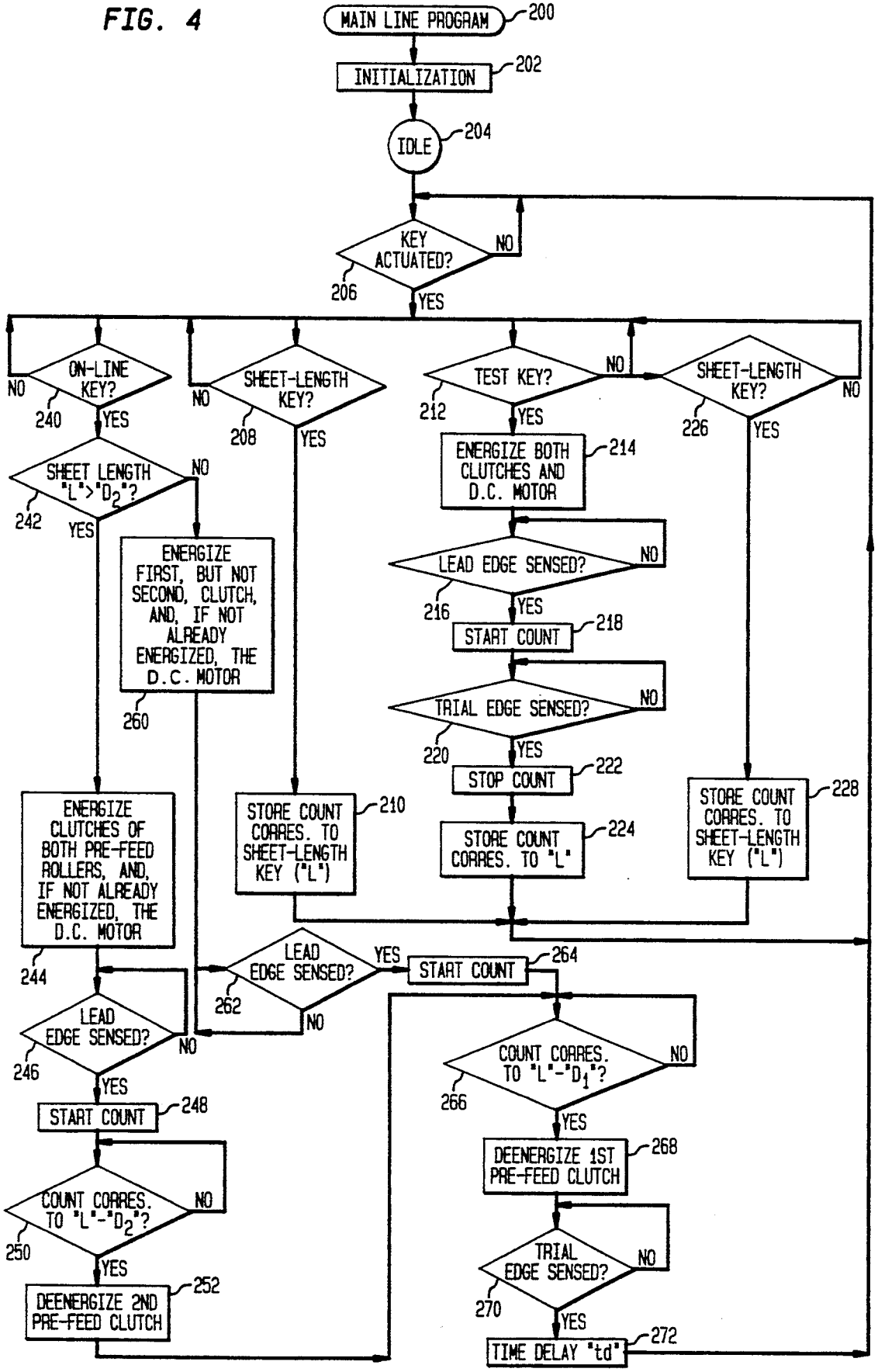
FIG. 4 is a flow chart of the control functions performed by the microcomputer of FIG. 3.

As shown in FIG. 4, the main line program 200, which is stored in the circuits of the main line program memory "I" (FIG. 3), commences with the step 202 (FIG. 4) of conventionally initializing the microcomputer 100 (FIG. 2), which generally includes establishing the initial voltage levels at the programmable ports K (FIG. 3) setting the timer and event counters "G" and, if necessary, initializing the d.c. motor 84, for example, as by scanning the microcomputer ports "K" associated with the d.c. motor 86 and determining whether or not one or more selected elements of the d.c. motor 86 are properly located for initiating operation thereof, and, if not, causing the d.c. motor 84 to be driven to its home position, if any.

Assuming the initialization step 202 (FIG. 4) is completed, the main line program 200 enters into an idle loop routine 204. In the idle loop routine, step 204, the program 200 implements the step 206 of initially determining whether or not any of the keyboard keys 126, (FIG. 2), 128 or 129, have been actuated and, if not, the program 200 (FIG. 4) continuously loops through step 206 until one of such keys 126, 128 or 129 have been actuated. Whereupon, the program 200 causes the microcomputer 102 to scan the programmable ports "K" (FIG. 3) thereof, to determine which of the keys 126 (FIG. 2), 128 or 129 has been actuated. Assuming that a plurality of selection keys 129 have been provided, a test key 126 has not been provided, and one of the sheet length selection keys 129 has been actuated, step 208 (FIG. 4), then, the program 200 implements the step 210 of storing the count corresponding to the selected sheet length key 129 (FIG. 2), which count corresponds to a predetermined length "L" of the respective sheets 12 a stack of sheets 12 which are to be fed from the apparatus 10. Thereafter, the program 200 causes processing to be returned to step 206. Assuming that the sheet length selection keys 129 (FIG. 2) are not provided, that a test key 126 is provided, and that the test key 124 has been actuated, step 212 (FIG. 4), then, the program 200 causes the microcomputer 102 (FIG. 2) to implement the step 214 of energizing both of the first and second clutches, 68 and 78, and the d.c. motor 84, for causing the rollers 45, 46, 47, 48 and 50 to feed a sheet 12 through the apparatus 10. Thereafter, the program 200 (FIG. 4) implements the step 216 of causing the microcomputer 102 to determine whether or not the sensing structure 110 (FIG. 2) has sensed the leading edge 12*a* of a sheet 12 being fed through the apparatus 10. Assuming that the leading edge 12*a* has not been sensed, step 216 (FIG. 4), then, the program 200 continuously loops through step 216 until the leading edge 12*a* is sensed. Whereupon, the programming causes the microcomputer 102 to implement the step 210 of starting a count of the encoder signals 122 received by the microcomputer 102, followed by the step 220 of the determining whether or not the trailing edge 21*b* (FIG. 2) of the sheet 12 has been sensed by the sensing structure 110. Assuming that the trailing edge 12*b* is not sensed, then, the program 200 (FIG. 4) continuously loops through step 220 until the trailing edge 12*b* is sensed. Whereupon, the program 200 causes the microcomputer 102 to implement the step 222 of stopping the count started in step 218, followed by the step 224 of storing the count of step 222 in the data memory "F" (FIG. 3). Thereafter, the program 200 (FIG. 4) returns processing to step 206. Accordingly, operation of the test key, step 212, results in storing a count corresponding to the overall length "L", step 224, of the sheet 12 which is fed through the apparatus 10. Assuming that both the test key 126 (FIG. 2) and the sheet length selection keys 129 are provided, then, if the test key 126 is not actuated step 212 (FIG. 4), and it is assumed that a sheet length selection key 129 is actuated, step 226, then, the program 200 causes implementation of the step 228 of causing the storage of a count corresponding to the selected sheet length selection key 129 (FIG. 2), which count corresponds to the length "L" of a sheet 12 of a stack of sheets 14 which is to be fed through the apparatus 10.

Assuming completion of implementation of the aforesaid program steps (FIG. 4), commencing with either step 208, or step 212 alone or in combination with step 226, and the return of processing to step 206, then, in any event, a sheet length "L" corresponding to the length of a representative sheet 12 (FIG.2) of a stack of sheets 12 which is to be fed by the apparatus 10 is stored in the microcomputer 102. In addition, it will be assumed that the stack 14 is appropriately loaded into the supporting structure 16.

Returning then to FIG. 4, and assuming that a determination has been made in step 240 that it is the on-line key, 128, which has been actuated, then, the program 200 (FIG. 4) causes the microcomputer 102 to implement the step 242 of determining whether or not the sheet length "L" is greater than the distance "$d_2$" (FIG. 1) between the second pre-feed roller's, outer periphery **50*b* and the sensing structure 110. Assuming that it is, step 242, the program 200 causes implementation of the step 244 of energizing both of the clutches 68 (FIG. 2) and 78, and, if not already energized, the d.c. motor 84. Thereafter, the program 200 (FIG. 4) causes implementation of the step 246 of determining whether or not the leading edge 12*a* (FIG. 1) of a lowermost sheet of 12 of the stack 14 is sensed by the sensing structure 100. Assuming that it is not, the program 200 (FIG. 4) causes processing to continuously loop through step 246 until the leading edge 12*a* of a sheet 12 is sensed. Whereupon, the program 200 causes implementation of the step 248 of starting a count of the encoder signals 122 received by the microcomputer 102, followed by the step 250 of determining whether or not the count corresponds to the count difference between the count corresponding to the stored length "L" of a sheet 12 and the count corresponding to the distance $d_2$ between the outer periphery 50*b* of the second pre-feed roller 50 and the sensing structure 100. Assuming that it is not, step 250, then, the program 200 continuously loops through step 250 until it is. Whereupon, the program 200 causes implementation of the step 252 of deenergizing the second pre-feed roller clutch 78 to cause the second pre-feed roller 50 to stop feeding. Returning to step 242, it is noted that if the inquiry thereof is negative, i.e., the sheet length "L" is not greater than the distance $d_2$ between the second pre-feed roller's outer periphery 50*b* and the sensing structure 110, then, the program 200 implements the step 260 of energizing the first 68, but not the second 78 pre-feed roller clutch, and, if it is not already energized, the d.c. motor 84. Accordingly, step 260 results in causing all of the rollers 44 (FIG. 2), 45, 46, 47 and 48 but not the roller 50 to be driven from the d.c. motor 84. Thereafter, the program 200 (FIG. 4) causes implementation of the step 262 of determining whether or not the sheet's leading edge 12*a* has been sensed and, assuming that it has not, step 262, processing is looped through step 262 until the sheet's leading edge 12*a* is sensed. Whereupon, the program 200 causes implementation of the step 264 of starting a count of the encoder signals 122 received by the microcomputer 102, step 264, which step 264 corresponds in all respects to step 248. Following steps 252 or 264, the program 200 causes the microcomputer, $d_2$ to then implement the step 266 of determining whether or not the count started in either of steps 248 or 264 corresponds to a count which is equal to the difference between the counts corresponding to the sheet length "L" and the distance "$d_1$" between the first pre-feed roller's outer periphery 48*b* and the sensing structure 100. Assuming that it is not, programming continuously loops through step 266 until it is. Whereupon, the program 200 causes the microcomputer 102 to implement the step 268 of deenergizing the first pre-feed roller's clutch 68 which results in the first pre-feed roller 48 being disconnected from drive by the d.c. motor 84. Thereafter, the program 200 causes implementation of the step 270 of determining whether or not the trailing edge 12*b* of the sheet 12 being fed from the apparatus 10 has been sensed by the sensing structure 110. Assuming that it is not, step 270, then the microcomputer program 200 causes processing to continuously loop through step 270 until it is. Whereupon, the program 200 causes implementation of the step of commencing a count of a predetermined time delay "td" which corresponds to a desired predetermined distance between the trailing edge 21*b* (FIG. 1) of a given lowermost sheet 12 which has been fed from the stack 14 and the leading edge 21*a* of the next lowermost sheet 12 which is to be fed from the stack 14. Thereafter, as shown in FIG. 4, processing is returned to step 206. However, it is noted that if the on-line key 128 (FIG. 2) has been depressed, according to the invention the depression of the on-line key 128 causes the key 128 to remain actuated until such time as it is again depressed, as a result of which the inquiry of step 206 (FIG. 4) will again be affirmatively answered. And, step 240 will again be implemented for processing the next lowermost sheet 12 of the stack 14 after the time delay "td", step 272. Accordingly, successive lowermost sheets 12 of the stack 14 will be sequentially fed therefrom until the stack 14 is depleted as until the on-line key 128, the, as shown in FIG. 4, processing will continuously loop through step 246 or step 262 after depletion of the stack 12 and until the on-line key 128 is depressed. As a result, the drive rollers 45, 47, 48 alone or in combination with the drive roller 50, will be continuously driven on a result of implementation of one or the other of steps 244 or 260 until the on-line key 128** is again depressed.

Without departing from the spirit and scope of the invention, the clutches 68 and 78 may, respectively, be replaced by commercially available clutch-brakes, which would, in the context of the invention, be operated differently than hereinbefore discussed, due to such clutch-brakes have three modes of operation, i.e., one in which the clutch-brakes may be selectively energized for causing the respective rollers, 48, 50, to be driven by the d.c. motor 84, another in which the clutch-brakes may be selectively energized for braking movement of the respective rollers, 48,50, and yet another wherein the clutch-brakes may be selectively energized for permitting the rollers, 48, 50, to freewheel in response to, for example, inertial forces. The clutch-brakes would be operated differently in that in addition to being selectively energized for driving the rollers, 48, 50, from the d.c. motor 84, as hereinbefore discussed in connection with the discussion of the clutches, 68, 78, they would be selectively energized for braking motion of the respective rollers, 48, 50, whenever such rollers, 48, 50, are not being driven. Moreover, without departing from the spirit and scope of the invention, the the counting structure 112 may be mounted on the lower outfeed roller drive shaft 45*a* rather than on the d.c. motor output drive shaft 86. And, the upper outfeed roller shaft 44*a* may be fixedly attached to the framework 11 to prevent rotation thereof, rather than being journaled thereto for rotation, to promote separation of the lowermost sheet 12 from any next lowermost sheet 12 inadvertently fed from the stack 14.

What is claimed is:

1. Apparatus for feeding respective sheets from a stack thereof comprising:

(a) means for supporting a plurality of sheets in an upright stack thereof, the supporting means including an upright wall, the supporting means including a deck extending beneath the wall and defining a path of travel for respective sheets fed from the stack, the deck extending transverse to the path of travel;

(b) means for successively feeding respective sheets downstream in the path of travel, the feeding means including opposed outfeed rollers downstream of the upright wall, the feeding means including an elongate first roller longitudinally extending transverse to the path of travel upstream of the upright wall, the feeding means including an elongate second roller longitudinally extending transverse to the path of travel upstream of the first roller, the feeding means including means for driving the outfeed and first and second rollers; wherein the driving means include:

(i) first clutch means connected to the first roller and including a first drive gear, the first clutch means electrically operable for connecting the first drive gear to the first roller and for disconnecting the first drive gear therefrom, the driving means including second clutch means connected to the second roller and including a second drive gear;

(ii) second clutch means electrically operable for connecting the second drive gear to the second roller and for disconnecting the second drive gear therefrom, the driving means including a DC motor having a pinion gear, the driving means including a gear belt looped about and disposed in meshing engagement with the respective pinion and drive gears;

(c) means for controlling the drive means, the controlling means including means for causing the driving means to intermittently drive at least one of the outfeed rollers and to selectively drive the first and second rollers, the causing means including a microcomputer, the microcomputer connected to the first and second clutch means for operation thereof, and the microcomputer connected to the DC motor for operation thereof.

2. The apparatus according to claim 1, wherein the microcomputer includes means for selectively operating the respective first and second clutch means for selectively connecting and disconnecting the first and second drive gears respectively to the first and second rollers.

3. The apparatus according to claim 1, wherein the respective sheets include a downstream leading edge and upstream trailing edge in the path of travel, the apparatus including means for sensing the leading and trailing edges of a given one of the respective sheets fed in the path of travel, the sensing means electrically connected to the microcomputer and providing respective signals thereto indicating that the leading and trailing edges of the respective sheets have been sensed, the microcomputer including means responsive to the sensing signals for storing data corresponding a length of said given sheet from the leading to trailing edge thereof, the microcomputer including means for storing data corresponding to a distance between the first roller and the sensing means and between the second roller and the sensing means as respectively measured along and path of travel the microcomputer including means for comparing said distance data corresponding to the length and distance and storing data corresponding to the comparison, and the microcomputer including means responsive to the comparison data for operating the first and second clutch means.

4. The apparatus according to claim 4, wherein the microcomputer means for operating the first and second clutch means includes means for operating the second clutch means for connecting the second drive gear and second roller when a respective sheet is to be fed and until the second roller is out of engagement therewith whenever the comparison data indicates that the given sheet length is greater than the distance between the second roller and the sensing means as measured along the path of travel.

5. The apparatus according to claim 4, wherein the microcomputer means includes means for operating the d.c. motor to start driving the at least one output roller whenever either one of the first and second rollers are being driven.

6. The apparatus according to claim 3, wherein the microcomputer means for operating the first and second clutch means includes means for operating the first clutch means for connecting the first drive gear and first roller when a respective sheet is to be fed and until the first roller is out of engagement therewith whenever the comparison data indicates that the given sheet length is less than the distance between the second rollers and the sensing means as measured along the path of travel.

7. The apparatus according to claim 6, wherein the microcomputer means for operating the first and second clutch means includes means for operating the first clutch means for connecting the first drive gear and first roller when a respective sheet is to be fed and until the first roller is out of engagement therewith whenever the comparison data indicates that the given sheet length is greater than the distance between the second roller and the sensing means as measured along the path of travel.

8. The apparatus according to claim 7, wherein the microcomputer means includes means for operating the d.c. motor for driving the least one output roller whenever either one of the first and second rollers are being driven.

* * * * *